US005223104A

United States Patent [19]

Grassi et al.

[11] Patent Number: 5,223,104

[45] Date of Patent: Jun. 29, 1993

[54] METHOD FOR PAINTING AN ENGINE

[75] Inventors: John A. Grassi, Princeville; William H. Gilbert, Peoria; Harry N. Gephart, Chillicothe; Deane I. Biehler, Peoria, all of Ill.

[73] Assignee: Caterpillar Inc., Peoria, Ill.

[21] Appl. No.: 768,416

[22] PCT Filed: Mar. 11, 1991

[86] PCT No.: PCT/US91/01581

§ 371 Date: May 6, 1992

§ 102(e) Date: May 6, 1992

[51] Int. Cl.[5] ..... C25D 13/00

[52] U.S. Cl. ..... 204/181.1; 204/181.3

[58] Field of Search ..... 204/181.1, 181.3

[56] References Cited

U.S. PATENT DOCUMENTS 3,616,392 10/1971 Haney ..... 204/181.1

4,074,010 2/1978 Knight ..... 427/195

4,808,441 2/1989 Chattha et al. ..... 427/386

FOREIGN PATENT DOCUMENTS 168315 7/1991 Japan .

*Primary Examiner*—John Niebling

*Assistant Examiner*—Kishor Mayekar

*Attorney, Agent, or Firm*—Robert A. McFall

[57] ABSTRACT

A method for painting an engine by the electrocoating process includes coating preselected components of the engine with an electrically nonconductive ceramic material prior to assembly, and pressurizing the engine prior to immersion in an electrically charged paint bath.

The method is particularly useful for avoiding paint deposition on preselected components, such as the hot exhaust elements, of an engine. A thermal insulating and corrosion resistant coating for the preselected components is thus provided, and undesirable paint burnoff during subsequent engine operation is avoided.

7 Claims, 1 Drawing Sheet

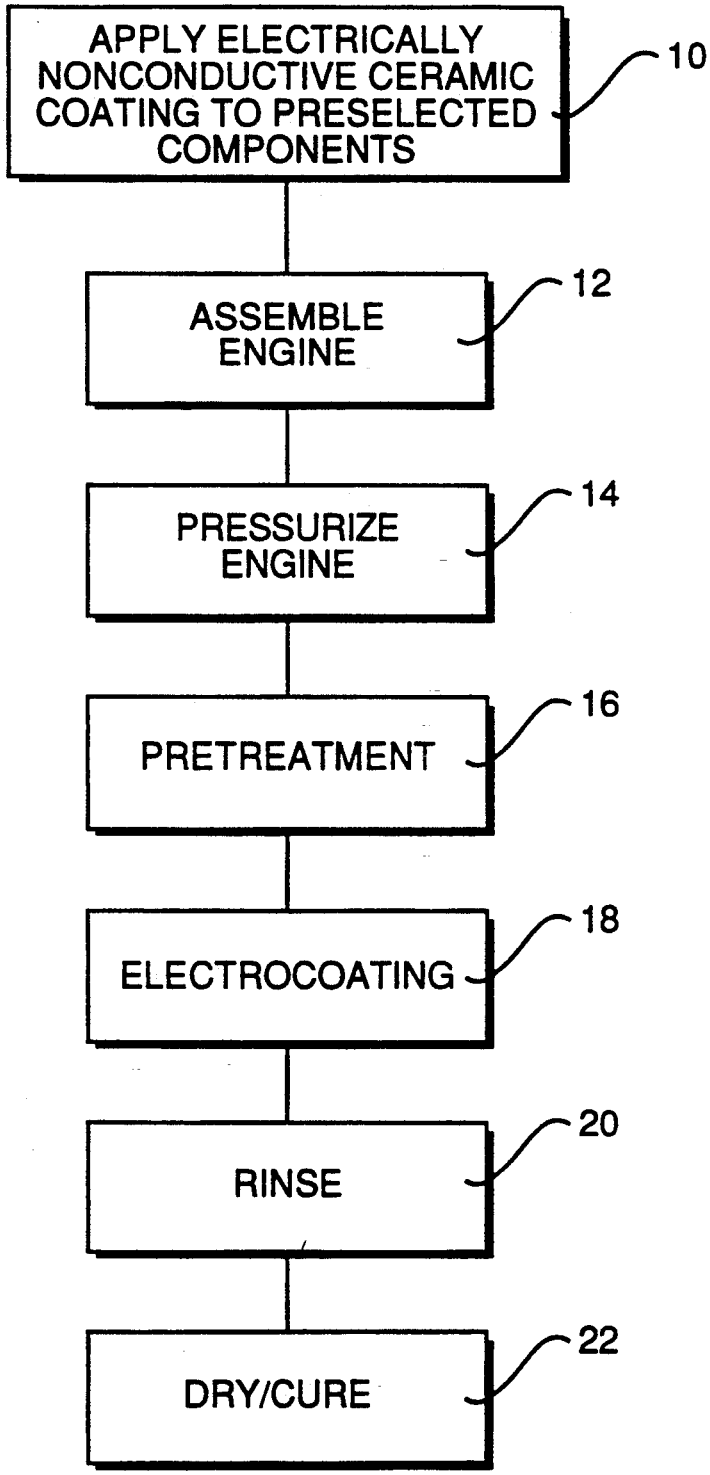
APPLY ELECTRICALLY NONCONDUCTIVE CERAMIC COATING TO PRESELECTED COMPONENTS
10
ASSEMBLE ENGINE
12
PRESSURIZE ENGINE
14
PRETREATMENT
16
ELECTROCOATING
18
RINSE
20
DRY/CURE
22

METHOD FOR PAINTING AN ENGINE

TECHNICAL FIELD

This invention relates generally to a method for painting an engine by the electrocoating process, and more particularly to such a process in which preselected components of the engine are coated with an electrically nonconductive ceramic material prior to assembly and painting.

BACKGROUND ART

Electrocoating is a well known process for painting electrically charged articles by immersion in a bath of paint having an electrical charge of opposite polarity to that of the article. In this painting process up to 90%, or more, of the paint adheres to the workpiece. Also, paint coatings applied by the electrocoating process have very uniform film properties, and the thickness of the paint film is accurately controllable. Further, there are virtually no runs, sags, or tears in the paint film.

However, for a number of reasons, the electrocoating process has not heretofore been used to paint assembled engines even though that process is especially effective for completely coating a workpiece having sharp edges, points, and hidden or otherwise inaccessible outer surfaces. First, there are surfaces on an assembled engine, such as exhaust manifolds and turbocharger housings, that become very hot during engine operation. If these surfaces are coated with paint, the paint will burn off during operation, producing smoke and undesirable fumes. To avoid paint burnoff it is necessary to carefully mask the surfaces that are subsequently subjected to high operating temperatures prior to the painting operation or, alternatively, strip the surfaces after painting. Both of these operations are labor intensive and difficult to control.

Submersion of the workpiece in a fluid paint bath, an integral step in the electrocute process, makes the requirements for effective masking or subsequent stripping more difficult. Furthermore, paint applied by the electrocoat process has excellent penetrating ability and can readily flow past gaskets, seals, bearings and temporary covers over openings on the engine. This, of course, is very undesirable and can seriously damage the engine.

The present invention is directed to overcoming the problems set forth above. It is desirable to have an effective, economical process for painting an assembled engine. It is also desirable to have such a process wherein preselected portions of the assembled engine are not coated with paint in the course of carrying out the paint process, and further, that paint not enter into the internal cavities and passageways of the engine.

DISCLOSURE OF THE INVENTION

In accordance with one aspect of the present invention, a method for painting an engine having internal cavities and passageways includes coating the outer surface of a preselected component of the engine with an electrically nonconductive ceramic material prior to assembly. The engine is then assembled and, after assembly, has both electrically conductive and electrically nonconductive outer surfaces. A flow of gas is directed into the internal cavities and passageways of the engine and the pressure of the gas in those internal cavities and passageways is maintained at a preselected value. The engine is cleaned and immersed in an electrically charged paint bath. The engine is then connected to a source of electrical charge having a polarity opposite that of the paint. The charged engine is maintained in the oppositely charged paint bath for a length of time sufficient to form a film of paint, having a thickness of at least about 0.013 mm (0.0005 in), on the electrically conductive outer surfaces of the engine. The engine is then removed from the paint bath, the source of electrical charge on the engine is disconnected, and the engine is rinsed. In the rinsing operation, substantially all paint is removed from the electrically nonconductive outer surfaces of the engine. Pressure is released from the internal cavities and passageways of the engine, and the paint film formed on the electrically conductive outer surfaces of the engine is cured.

Other features of the method for painting an engine include removing surface oxides and cleaning the preselected component prior to applying a porcelain enamel coating to predetermined surfaces of the preselected component. After drying, the preselected component is heated for a period of time and at a temperature sufficient to fuse the porcelain coating.

BRIEF DESCRIPTION OF THE DRAWING

The single drawing is a block diagram of the principal steps of the process embodying the present invention.

BEST MODE FOR CARRYING OUT THE INVENTION

The principal steps of a method for painting an engine, according to the preferred embodiment of the present invention, are shown in block form in the single drawing. The method comprises initially applying an electrically nonconductive ceramic coating to the outer surface of at least one preselected component of the engine, as indicated by the reference numeral 10. Preferably, the electrically nonconductive ceramic coating is a porcelain enamel material applied to at least the outer surfaces of an exhaust component of the engine, such as an exhaust manifold or a turbocharger housing.

The surfaces of the preselected component that are to be coated should be prepared and cleaned prior to deposition of the ceramic coating. It is especially important that the surfaces to be coated with porcelain be substantially free of oxides and grease or oils. In the preferred embodiment of the present invention, the preselected components are carried, by conveyor, through a grit blaster in which small abrasive particles are directed, under pressure, at surfaces of the component that have been predetermined as receptors of the porcelain coating. Advantageously, the abrasive grit may be directed at both internal and external surfaces of the preselected component.

After undesirable surface oxides are removed, the preselected component may be further cleaned by hand wiping or high pressure air jet, if required, to remove substantially all deleterious foreign material from the predetermined surfaces. Alternatively, if required, the preselected component may be cleaned by vapor degreasing, dipping in a cleaning solution, or other means.

The porcelain enamel coating is preferably applied to the prepared predetermined surfaces of the preselected component by dipping the component in a tank containing a porcelain enamel slip. It may be necessary to intentionally avoid coating surfaces of the preselected components that are, at assembly, joined to mating surfaces of adjacent engine components. Such surfaces should be masked prior to application of the ceramic coating.

When the enamel coating is applied by dipping, i.e., immersion, both internal and external surfaces of the preselected component may be, advantageously, coated simultaneously. It is particularly desirable to coat both the internal and external surfaces of engine exhaust system components such as turbocharger housings and exhaust manifolds. The ceramic coating applied to the external surface of these components forms an electrically nonconductive coating that prevents the formation of a paint film thereon during the subsequent electrocoat painting process, provides a highly desirable surface finish, and additionally protects these high operating temperature components from subsequent oxidation. The ceramic coating formed on the internal surface of such components thus provides oxidation and corrosion protection for the internal exhaust passages, and also provides an effective thermal barrier coating that may enhance the operating efficiency of the engine.

After deposition of the porcelain enamel, the coating is dried, preferably by carrying the component through a hot circulating air chamber. The coating is then fused by heating to a temperature, and held at that temperature, for a length of time sufficient to fuse the porcelain enamel coating.

In an illustrative embodiment of the present invention, turbocharger housings and exhaust manifolds were coated, by dipping, in a cast iron porcelain enamel slip. Both the internal and external surfaces of the articles were coated. After dipping, the housings and manifolds were dried with hot air, then placed in an oven heated to a temperature of about 760° C. (1400° F.), and held in the oven for about 0.5 hours. Alternatively, the porcelain coating may be fused with thermal heating provided by high intensity lamps, electromagnetic energy sources, or other heating means.

Other electrically nonconductive ceramic coatings that are suitable for application to preselected engine components prior to painting include refractory glass and both oxide and non-oxide ceramics. The coating may be applied by flame or plasma spray in addition to dipping.

After applying the electrically nonconductive ceramic coating to at least the outer surface of a preselected engine component, the engine is assembled, as indicated at Block 12 of the process flow diagram. The assembled engine comprises a number of individual components, some of which have surfaces that are not coated and are electrically conductive, and other components which were preselected to receive the electrically nonconductive coating. The assembled engine thus has both electrically conductive and electrically nonconductive outer surfaces.

It may be desirable to test the engine immediately after assembly and prior to painting. An important feature of the porcelain enamel coating on the preselected components of the engine is that the engine may be tested and operated for an extended time without any deterioration of the coating. If the engine is tested immediately after assembly, engine fluids such as oil and coolant are drained from the engine prior to preparation for painting.

Prior to painting, covers are placed over openings in the engine, such as the crankcase oil fill, air intake, engine exhaust opening, cooling water jacket, and flywheel openings. These covers are generally constructed of a nonconductive plastic or rubber material and are held in place, over the opening by conventional band clamps.

Prior to pretreatment and painting, air line fittings are installed in selected engine openings, such as the covered openings described above. The openings are selected to provide fluid communication between the fittings installed in the openings and all internal cavities and passageways of the engine. In the illustrative embodiment of the present invention, five air line fittings are installed in respective covers over the crankcase breather, air intake, engine exhaust, coolant drainage, and flywheel housing openings of the engine. The fittings are typically adapted at one end to mate with a respective port or hole provided in the cover, and have a quick disconnect air hose fitting at the second, or opposite, end. As indicated at Block 14, flexible air lines are connected to the fittings and a flow of pressurized air is directed through the fittings to the internal cavities and passageways of the engine. The air flow to the engine is regulated to provide a pressure sufficient to prevent the ingress of cleaning agents, surface treatment agents, rinse water, or paint into the cavities and passageways of the engine throughout pretreatment, immersion of the engine in the paint bath, and the final rinse cycle. It has been found that an air pressure of about 5 psi (34 kPa) is sufficient to prevent such penetration of undesirable fluids into bearings, seals, openings or other points of entry to the internal portions of the engine.

Prior to the deposition of paint by the electrocoat process, the surfaces to be coated should be free of dirt, oil or other undesirable foreign substances. In the preferred embodiment of the present invention, the assembled and pressurized engine is subjected to an alkaline wash in a spray booth, or tank. After cleaning with the alkaline wash, the engine is rinsed and then given a conversion coating to provide improved corrosion resistance and adhesion of the subsequently formed paint coating. In the present embodiment, an iron phosphate coating was applied, followed by a deionized water rinse. Typically, the pretreatment process, represented by Block 16, may include from about 3 to 9 stages, depending on the initial cleanliness of the article and the quality required of the final paint coating.

Following the pretreatment operations, a paint film is formed on the electrically conductive outer surfaces of the engine. In the preferred embodiment of the present invention, a cathodic electrocoating system is used to form the paint film while the engine is immersed in a tank containing a paint specially formulated for electrocoat deposition, such as a commercial low bake, cathodic, electrocoat paint. In the cathodic system, the engine is charged negatively while the paint particles carry a positive electrical charge. The engine thus becomes the cathode of an electrical circuit.

In the illustrative embodiment of the present invention, a negative charge of about 350 V is placed on the engine, i.e., the voltage differential between the engine and the paint charging electrodes, or anodes, is about 350 V.

The electrocoat paint film formation step is represented by Block 18 of the process flow chart. In this step, the engine is held in the electrocoating tank, under the surface of the paint, for a length of time sufficient to form a film of paint having a desired thickness on the electrically conductive surfaces of the engine. It has been found, that using the parameters described above, that a film having a thickness of about 1.6 mils (0.04 mm) is formed by holding the negatively charged engine in the paint bath for about 210 seconds. It has been found that a heavy duty 6 cylinder diesel engine, such as a Caterpillar ® 3406 Series engine, has an initial current draw of about 160 A which drops as the coating increases, to about 20 A when the coating approaches about 1.6 mils (0.04 mm). Preferably, the engine is held in the electrocoating tank for a length of time sufficient to form a coating of at least about 0.5 mil (0.013 mm) and, desirably, as thick as about 3 mils (0.076 mm). Even thicker coatings can be formed if the engine is held in the paint bath for a longer time.

Alternatively, the engine may be coated in an anodic electrocoating reaction in which the engine is positively charged and the paint particles are negatively charged.

After forming a paint film of the desired thickness on the desired electrically conductive surfaces, the electrical charge is removed and the engine is removed from the paint bath. Excess paint, including substantially all of the paint from the electrically nonconductive surfaces of the engine, is removed by a series of rinses as indicated at Block 20. The final rinse is, desirably, a deionized water rinse.

After rinsing, the pressurized air lines are disconnected from the fittings that were temporarily installed on the engine, thereby depressurizing the internal cavities and passageway of the engine. As indicated at Block 22, the engine is then placed in an oven where the paint film formed on the electrically conductive engine surfaces is cured. In the illustrative embodiment of the present invention, the engine is placed in an oven heated to about 180° F. (82° C.), and held in the oven at that temperature for about 1 hour.

After removal from the oven, and removal of the previously installed fittings and covers, an engine painted according to the present invention is essentially ready to ship or install on a vehicle. No additional steps are required to strip paint or carefully remove strategically applied masking materials. Additionally, the low bake paint used in the illustrative embodiment of the present invention permits the installation of decals, insignia, and oil and/or fuel filters on the engine prior to painting. If applied prior to painting, the decals and insignia may be conveniently printed on an electrically nonconductive film material. Furthermore, during the electrocoat paint process a paint film will not form on prepainted oil and fuel filter canisters.

INDUSTRIAL APPLICABILITY

Engines painted according to the process embodying the present invention have superior finish and appearance. Further, because there are no paint deposits on the hot exhaust components of the engine, there is no paint burnoff during initial operation. This feature is highly desirable during initial testing of assembled vehicles at vehicle manufacturing facilities, and is particularly useful in enclosed operating environments such as indoor generator sets and marine applications.

As noted above, the porcelain enamel coating on the high operating temperature components of the engine also provides excellent oxidation and corrosion protection, thereby prolonging the service life of these components. Also, porcelain enamel is available in a number of formulations adapted to match the thermal expansion characteristics of a variety of substrate materials, such as cast iron, steel, or aluminum. When the thermal expansion properties are properly matched the porcelain coated components have excellent shock resistance and retain their appearance and thermal insulating properties.

Furthermore, when the porcelain enamel coating is also applied to the internal surfaces of the high operating temperature components, internal rusting is substantially eliminated, thereby preventing subsequent damage to downstream components such as turbine blades, catalytic convertors or particulate traps.

Other aspects, objects and advantages of this invention can be obtained from a study of the drawings, the disclosure, and the appended claims.

We claim:

1. A method for painting an engine having internal cavities and passageways, comprising:

applying an electrically nonconductive ceramic coating to an outer surface of at least one preselected component of said engine prior to assembly;

assembling said engine, said engine having, after assembly, both electrically conductive and electrically nonconductive outer surfaces;

directing a flow of gas into said internal cavities and passageways of said engine;

cleaning said engine;

immersing said engine in a bath of paint;

connecting said engine to a source of electrical charge having a predetermined polarity;

charging the paint in said bath with an electrical charge having a polarity opposite that of said engine charge;

maintaining said charged engine in said oppositely charged paint bath for a time sufficient to form a paint film having a thickness of at least about 0.013 mm (0.0005 in) on the electrically conductive outer surfaces of said engine;

disconnecting the source of electrical charge from said engine;

removing the engine from said paint bath;

rinsing the engine and removing substantially all paint from the electrically nonconductive outer surfaces of said engine;

depressurizing said internal cavities and passageways; and, curing said paint film formed on the electrically conductive outer surfaces of said engine.

2. A method for painting an engine, as set forth in claim 1, wherein said step of applying an electrically nonconductive ceramic coating to at least one preselected component of said engine, includes:

removing surface oxides from predetermined surfaces of said preselected component;

cleaning said preselected component;

applying a porcelain enamel coating to said predetermined surfaces of the preselected component;

drying said applied porcelain enamel coating, and, heating said coated preselected component for a time and at a temperature sufficient to fuse the porcelain enamel coating.

3. A method for painting an engine, as set forth in claim 2, wherein the step of cleaning said preselected component includes placing said component in a chamber containing a cleaning agent, and maintaining said component in contact with said agent for a time sufficient to remove substantially all deleterious foreign material from the predetermined surfaces of said preselected component.

4. A method for painting an engine, as set forth in claim 2, wherein the step of applying a porcelain enamel coating to the predetermined surfaces of said preselected component, includes dipping said preselected component in a tank containing a porcelain enamel slip.

5. A method for painting an engine, as set forth in claim 2, wherein said step of heating said coated preselected component includes placing said component in an oven heated to a temperature of about 760° C. (1400° F.) for about 0.5 hours.

6. A method for painting an engine, as set forth in claim 1, wherein the step of cleaning said engine includes forming a phosphate conversion coating on the electrically conductive outer surfaces of said engine.

7. A method for painting an engine, as set forth in claim 1, wherein said preselected component is an exhaust component of said engine.

* * * * *